US007495160B2

(12) United States Patent
Hoshino et al.

(10) Patent No.: US 7,495,160 B2
(45) Date of Patent: Feb. 24, 2009

(54) REINFORCING STRUCTURE FOR METAL SHELL AND MANUFACTURING METHOD FOR METAL SHELL

(75) Inventors: Takanori Hoshino, Seto (JP); Ryuji Ozawa, Ikoma (JP)

(73) Assignee: Hoshino Gakki Mfg. Co., Ltd. (JP)

( * ) Notice: Subject to any disclaimer, the term of this patent is extended or adjusted under 35 U.S.C. 154(b) by 0 days.

(21) Appl. No.: 11/938,404

(22) Filed: Nov. 12, 2007

(65) Prior Publication Data

US 2009/0025531 A1 Jan. 29, 2009

(30) Foreign Application Priority Data

Jul. 24, 2007 (JP) ..... 2007-192420

(51) Int. Cl.
*G10D 13/08* (2006.01)

(52) U.S. Cl. ..... 84/411 R

(58) Field of Classification Search ..... 84/421
See application file for complete search history.

(56) References Cited

U.S. PATENT DOCUMENTS

| | | | | |
|---|---|---|---|---|
| 1,832,227 | A | 11/1931 | Ludwig | |
| 6,921,854 | B2 * | 7/2005 | Gatzen | 84/411 R |
| 7,310,866 | B2 * | 12/2007 | Balma et al. | 29/446 |
| 2007/0251373 | A1 * | 11/2007 | Fadda | 84/411 R |

* cited by examiner

*Primary Examiner*—Kimberly R Lockett
(74) *Attorney, Agent, or Firm*—Ostrolenk, Faber, Gerb & Soffen, LLP

(57) ABSTRACT

A metal shell is composed of a trunk portion and a pair of reinforcing portions provided at opening ends of the trunk portion. The trunk portion is formed of a metallic cylinder, the reinforcing portion is formed of a metallic ring having the same diameter as that of the cylinder, and the ring is joined to at least an opening end of the cylinder.

16 Claims, 6 Drawing Sheets

REINFORCING STRUCTURE FOR METAL SHELL AND MANUFACTURING METHOD FOR METAL SHELL

BACKGROUND OF THE INVENTION

The present invention relates to a reinforcing structure for a metal shell and a manufacturing method for a metal shell.

Generally, a drum includes a cylindrical shell and a pair of drum heads mounted to both side opening ends of the shell. When the drum is played, the drum head vibrates as a result of being beaten, and the vibration sound is amplified by the shell. In this manner, the drum shell not only functions as a fulcrum when the beaten drum head vibrates but also functions as a resonator which amplifies the vibration sound of the drum head. Based on this point, rigidity is required in the shell to prevent deformation due to tension of the drum head. However, when sound response and sustain, etc., are required, it is necessary to form the drum shell with a thin wall. In such a case, in order to form a thin-walled shell, reinforcement of only the opening ends to which drum heads are mounted has been performed.

In the case of a metal shell, as a method for forming reinforcing portions at opening ends of the shell, known is a method for, for example, as shown in FIG. 5, forming a cylinder from a rectangular metal plate and bending both opening ends of the cylinder to form reinforcing portions 51 that are V-shaped in cross-section. In addition, as a method for forming reinforcing portions at opening ends of a metal shell, for example, U.S. Pat. No. 1,832,227 discloses a method shown in FIGS. 6(A) to 6(D). According to this method, first, as shown in FIG. 6(A), two disks 61*a* and 61*b* are punched out of one metal plate 60. Next, as shown in FIG. 6(B), by pressing such as deep drawing or spinning, the disk 61*a* is shaped to form an upper shell 62*a*, and the disk 61*b* is shaped to form a lower shell 62*b*. Then, in order to form opening ends of a metal shell, a bottom central part P of each shell 62*a*, 62*b* is cut in a circle. Subsequently, as shown in FIG. 6(C), the opening end of each shell 62*a*, 62*b* is bent to form a reinforcing portion 63*a*, 63*b* that is triangular-shaped in cross-section, respectively. Lastly, both shells 62*a* and 62*b* are integrated by welding, whereby a metal shell 65 as shown in FIG. 6(D) is fabricated.

However, according to the method shown in FIG. 5, although a metal shell can be formed from a relatively small amount of material, since all parts of the metal shell are formed from one metal plate, the wall thickness cannot be differentiated between a trunk portion 50 and the reinforcing portions 51 of the metal shell. That is, since the reinforcing portions 51 are formed with the same wall thickness as that of the trunk portions 50, when the metal shell is formed with a thin wall, rigidity of the opening ends of the metal shell cannot be sufficiently secured. On the other hand, when a thick-walled metal plate is used to form a metal shell, opening ends of the metal shell cannot be skillfully bent, so that the reinforcing portions 51 cannot be formed in a desirable shape.

In addition, according to the method shown in FIGS. 6(A) to 6(D), since the reinforcing portions 63*a* and 63*b* that are triangular-shaped in cross-section are formed on both opening ends of a metal shell, the rigidity of the opening ends of the metal shell can be made higher than that by the method shown in FIG. 5. However, for this method, a die, a jig, and the like for deep drawing or spinning are necessary. In addition, this is not considered as a highly productive method, and as shown in FIG. 7, there is also a drawback that a large waste part (shaded part) is produced in the metal plate 60, which is a raw material. Furthermore, since a thick-walled portion is produced at a joint part between both shells 62*a* and 62*b*, there is also a problem that vibration of the metal shell is hindered, and the function as a resonator is impaired.

SUMMARY OF THE INVENTION

It is an objective of the present invention to provide a reinforcing structure for a metal shell and a manufacturing method for a metal shell, which reduce the thickness of a trunk portion while securing rigidity at opening ends of a metal shell, and simplify the manufacturing process.

To achieve the foregoing and other objectives and in accordance with a first aspect of the present invention, a reinforcing structure for reinforcing an opening end of a metal shell to which a drum head is mounted is provided. The metal shell is composed of a trunk portion and a reinforcing portion provided at an opening end of the trunk portion. The trunk portion is formed of a metallic cylinder. The reinforcing portion is formed of a metallic ring having the same diameter as that of the cylinder. The ring is joined to at least one opening end of the cylinder.

In accordance with a second aspect of the present invention, a manufacturing method for a metal shell with a reinforcing structure for reinforcing an opening end of a metal shell to which a drum head is mounted is provided. The method includes: shaping a rectangular metal plate to form a cylinder; shaping a metal pipe to form a ring having the same diameter as that of the cylinder; and joining the ring to an opening end of the cylinder.

DETAILED DESCRIPTION OF THE PREFERRED EMBODIMENTS

Hereinafter, one embodiment of the present invention will be described with reference to FIGS. 1 to 4.

Figure 1:
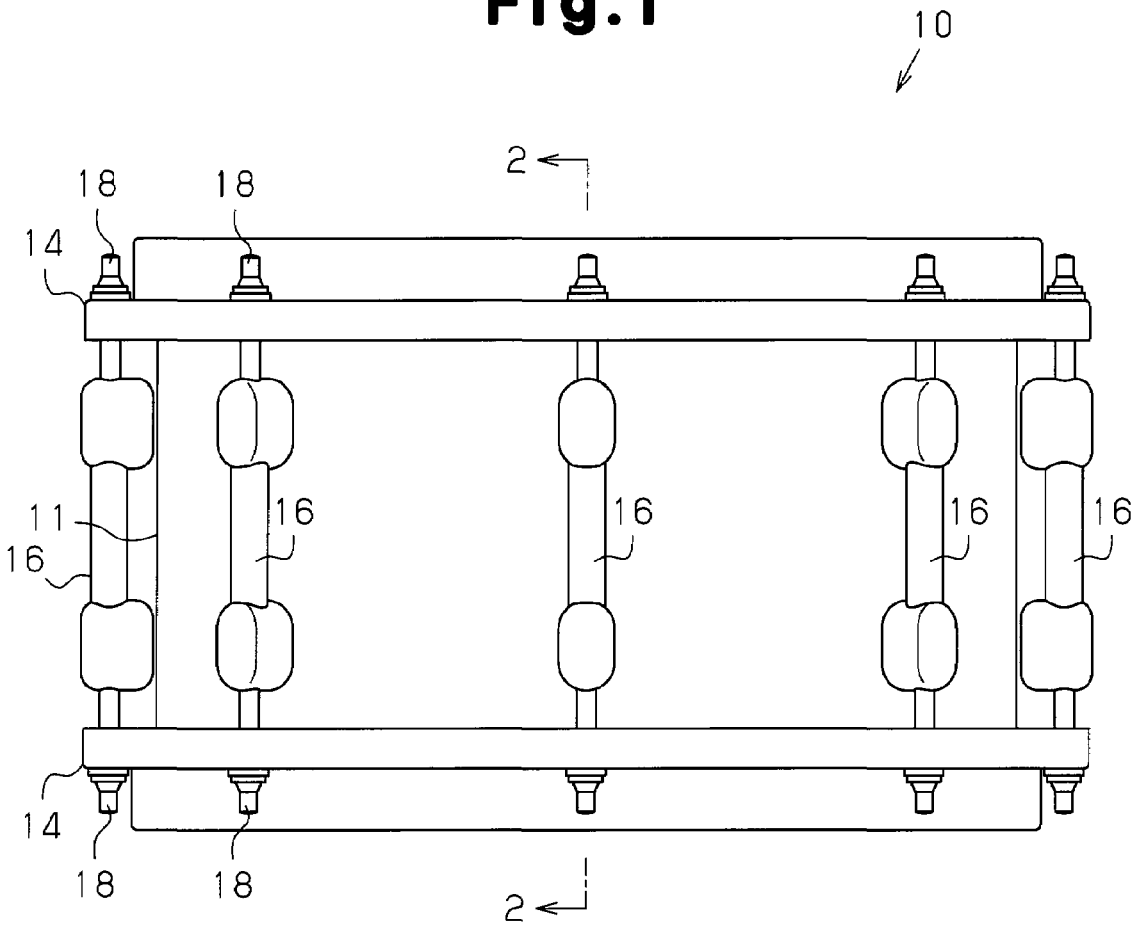
FIG. 1 is a side view showing the entire configuration of a drum.
Figure 2:
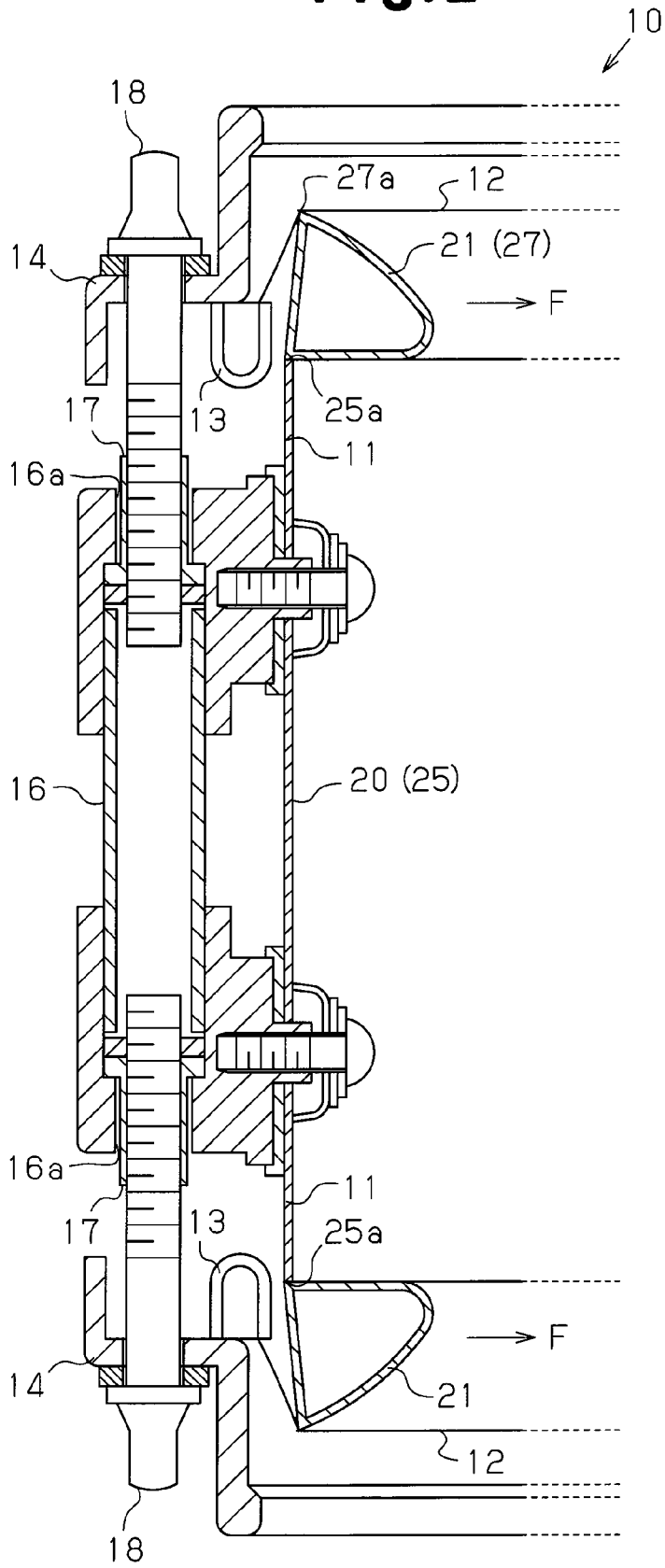
FIG. 2 is a cross-sectional view taken along line 2-2 of FIG. 1.

As shown in FIGS. 1 and 2, a drum 10 includes a metal shell 11 (hereinafter, referred to as a shell) and a pair of drum heads 12 that block upper and lower opening ends of the shell 11. The drum head 12 produces a vibration sound when being beaten by a player. The shell 11 amplifies the vibration sound produced at the drum head 12.

At the upper and lower opening ends of the shell 11, respectively provided are an annular head frame 13 that holds the drum head 12 and an annular hoop 14 to be fixed to the shell 11. Each hoop 14 is, with its lower surface made in contact with the outer surface of the head frame 13, arranged respectively on the upper and lower peripheries of the shell 11. Each drum head 12 is supported, while being held by the head frame 13 via the hoop 14, at the upper and lower opening ends of the shell 11, respectively.

On the outer circumferential surface of the shell 11, provided are a plurality of lugs 16 to fix each hoop 14 and a plurality of lug bolts 18 to adjust the tension of each drum head 12. Each lug 16 has a longitudinal hole 16*a*, and in both ends of the longitudinal hole 16*a*, lug nuts 17 are housed and fixed, respectively. By inserting each lug bolt 18 in a hole of the hoop 14 and tightening the distal end of the lug bolt 18 into the lug nut 17 within the lug 16, the head frame 13 is pressed by the hoop 14, whereby the tension of each drum head 12 is increased. On the other hand, by loosening each lug bolt 18, the pressure on the head frame 13 by the hoop 14 is released, whereby the tension of each drum head 12 is reduced.

As shown in FIGS. 2 and 3, the shell 11 includes a cylindrical trunk portion 20 and a pair of reinforcing portions 21 provided at both opening ends of the trunk portion 20. The trunk portion 20 is a main part of the shell 11 that functions as a resonator. The reinforcing portions 21 are provided to prevent deformation of the shell 11 due to tension of the drum heads 12. The trunk portion 20 is formed of a cylinder 25. The cylinder 25 is formed of a metal material such as titanium or a titanium alloy for the reason of being lightweight and excellent in propagation speed of sound and internal damping ratio. The cylinder 25 is formed by shaping one metal plate 26 exhibiting a rectangular shape into a cylindrical form and welding both edges of the metal plate 26.

Each reinforcing portion 21 is formed of a metallic ring 27 having the same diameter as that of the cylinder 25. The ring 27 is formed of a metal material such as titanium, a titanium alloy, brass, or stainless steel for the reason of having a high rigidity. The ring 27 is formed by shaping a metal pipe that is circular-shaped in cross-section into a triangular shape in cross-section, further shaping the same into an annular shape, and welding both edges of the metal pipe. Therefore, in the shell 11, each reinforcing portion 21 is hollow, and has a triangular shape in cross-section. Thus, the shell 11 is composed of one cylinder 25 and a pair of rings 27, and is formed by welding or brazing each ring 27 to each opening end of the cylinder 25.

The ring 27 is joined, at the opening end of the cylinder 25, to an end face 25*a* of the cylinder 25. At this time, an outer circumferential surface of the ring 27 is arranged substantially flush with an outer circumferential surface of the cylinder 25. Due to this arrangement, in each reinforcing portion 21, a protrusion 27*a* of each ring 27 contacts each drum head 12 along its outer circumferential rim. Accordingly, each drum head 12 is mounted, via the protrusion 27*a* of each ring 27, to the head frame 13 so as to be vibratable.

As the result of a vibration of the drum head 12 produced when the drum is played, tightening of the lug bolts 18, and the like, an inward (an arrow direction shown in FIG. 2) force F due to the tension of the drum head 12 acts on the opening end of the shell 11. Therefore, the shell 11 is deformed by the tension of the drum head 12, so that not only is the function as a fulcrum impaired when the drum head vibrates but the function as a resonator may also be impaired. In that respect, according to the present embodiment, since both opening ends of the shell 11 have been reinforced by the reinforcing portions 21, a deformation of the shell 11 by the above-described inward force F is inhibited.

Next, a manufacturing method for the shell 11 of the present embodiment will be described with reference to FIGS. 3(A) to 3(C).

Figure 3A:
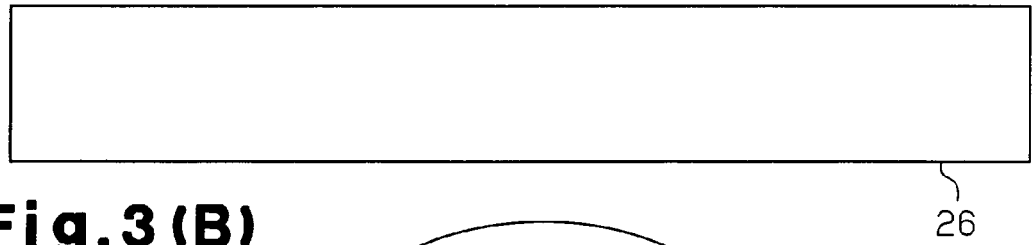
FIG. 3(A) is an explanatory view showing a manufacturing method for a shell of the present embodiment.
Figure 3B:
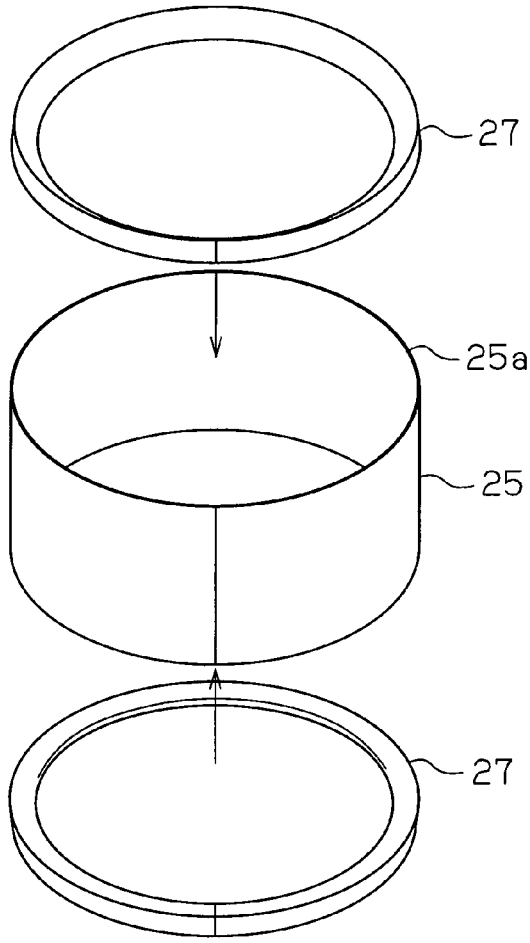
FIG. 3(B) is an explanatory view showing the manufacturing method for a shell of the present embodiment.
Figure 3C:
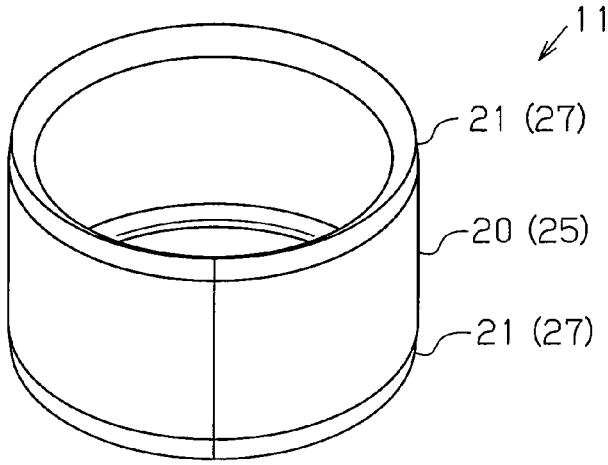
FIG. 3(C) is an explanatory view showing the manufacturing method for a shell of the present embodiment.

First, as shown in FIGS. 3(A) and 3(B), the rectangular metal plate 26 is shaped into a cylindrical shape by use of a three-roller machine. And, by welding both ends of the metal plate 26, the metallic cylinder 25 is formed. In addition, for example, by use of a drawing machine, a metal pipe that is circular-shaped in cross-section is shaped into a triangular shape in cross-section. Further, by shaping the shaped pipe into an annular shape and then molding both ends thereof, the ring 27 is formed. By arranging the obtained ring 27 at each opening end of the cylinder 25 and welding each ring 27 to the cylinder 25 from the outside of the cylinder 25, the shell 11 shown in FIG. 3(C) is formed. When this method is used, since the reinforcing portions 21 and the trunk portion 20 composing the shell 11 are formed of separate components, the wall thickness can be differentiated between the reinforcing portions 21 and the trunk portion 20. Thereby, the trunk portion 20 being a main part of the shell 11 can be formed with a thinner wall than that of the reinforcing portions 21. In addition, it is also possible to form the trunk portion 20 of the shell 11 from a raw metal material different from that of the reinforcing portions 21.

According to the present embodiment, the following advantages are obtained.

(1) The trunk portion 20 is formed of the metallic cylinder 25, and each reinforcing portion 21 is formed of the metallic ring 27 having the same diameter as that of the cylinder 25. According to this construction, by joining the metallic ring 27 to the opening end of the metallic cylinder 25, the rigidity of the opening end of the shell 11 is increased. In addition, since the trunk portion 20 and the reinforcing portions 21 composing the shell 11 are formed of separate components, the wall thickness is differentiated between the trunk portion 20 and the reinforcing portions 21. Thereby, the trunk portion 20 can be formed with a thin wall while securing the rigidity of the opening ends of the shell 11. In addition, it is also possible to form the trunk portion 20 from a raw metal material different from that of the reinforcing portions 21, so that options of the metal material used for the trunk portion 20 are greatly increased. That is, to the trunk portion 20 of the shell 11 functioning as a resonator, a design excellent in acoustic properties is provided.

(2) Since each ring 27 is joined to each opening end of the cylinder 25, the rigidity of each opening end of the shell 11 is increased. Thereby, distortion of the shell 11 due to tension of the drum head 12 is further suppressed.

(3) Since the reinforcing portion 21 is hollow, the shell 11 can be reduced in weight. In addition, since the reinforcing portion 21 has a triangular shape in cross-section, the rigidity of the opening end of the shell 11 is further increased.

(4) The ring 27 is joined, at the opening end of the cylinder 25, to the end face 25*a* thereof. According to this construction, since the joining area between the ring 27 and the cylinder 25 is small, the time and material required for joining the ring 27 to the opening end of the cylinder 25 are saved. In addition, since the joining work between the ring 27 and the cylinder 25 can be performed from the outside of the cylinder 25, the workability when joining the ring 27 and the cylinder 25 is improved.

(5) The cylinder 25 is formed of a metal material such as titanium or a titanium alloy. Since the titanium or titanium alloy is a material excellent in propagation speed of sound and small in internal damping ratio, the shell 11 that is excellent in acoustic properties such as sound response and sustain is provided.

(6) The shell 11 is formed by forming the metallic cylinder 25 from the rectangular metal plate 26, forming the ring 27 having the same diameter as that of the cylinder 25 from a metal pipe, and welding the ring 27 to both opening ends of the cylinder 25. According to this method, unlike the conventional method for forming a set of shells by shaping two disks punched out of one metal plate 26 and integrating both shells by joining, the shell 11 is shaped by use of a three-roller machine, which is a general-purpose machine. In addition, since the productivity is improved in comparison with that of the conventional method and no spinning machine or press machine is used, fewer types of dies and jigs are used. Also, since the metal plate 26 to be a raw material produces almost no waste part, the material cost is also reduced. Furthermore, since the trunk portion 20 of the shell 11 is formed from one metal plate, no thick-walled portion that hinders vibration of the shell 11 is formed, either. Accordingly, the function of the shell 11 as a resonator is never impaired, either.

Figure 4:
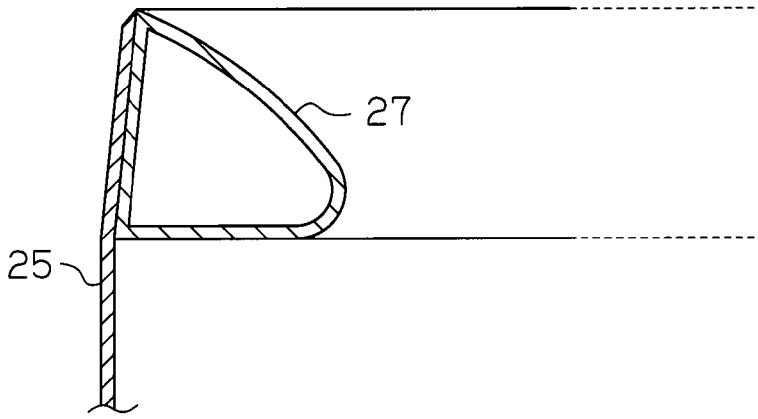
FIG. 4 is a partially enlarged cross-sectional view showing an opening end portion of a shell according to a modified embodiment.
Figure 5:
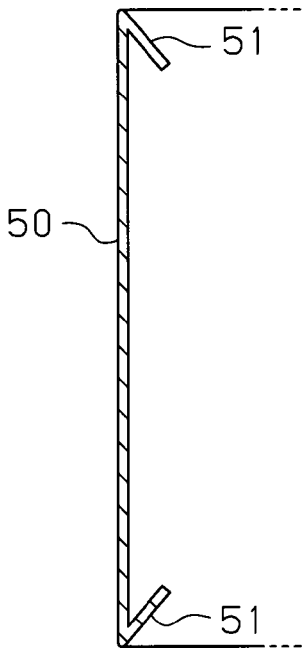
Fig.5(Prior Art)
FIG. 5 is a partial cross-sectional view showing an opening end portion of a conventional shell.
Figure 6A:
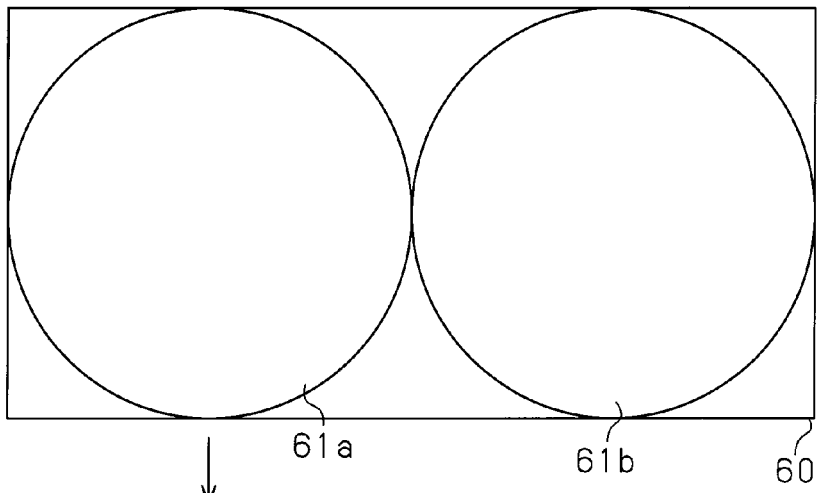
Fig.6(A) (Prior Art)
FIG. 6(A) is an explanatory view showing a manufacturing method for a conventional shell.
Figure 6B:
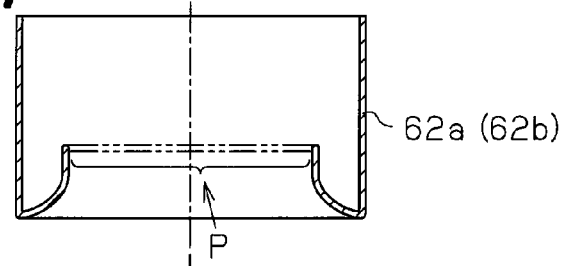
Fig.6(B) (Prior Art)
FIG. 6(B) is an explanatory view showing the manufacturing method for the conventional shell.
Figure 6C:
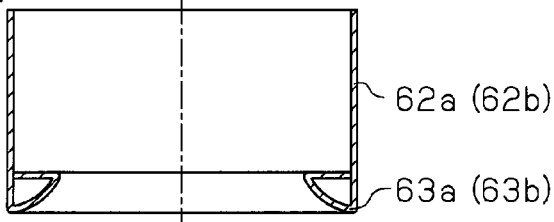
Fig.6(C) (Prior Art)
FIG. 6(C) is an explanatory view showing the manufacturing method for the conventional shell.
Figure 6D:
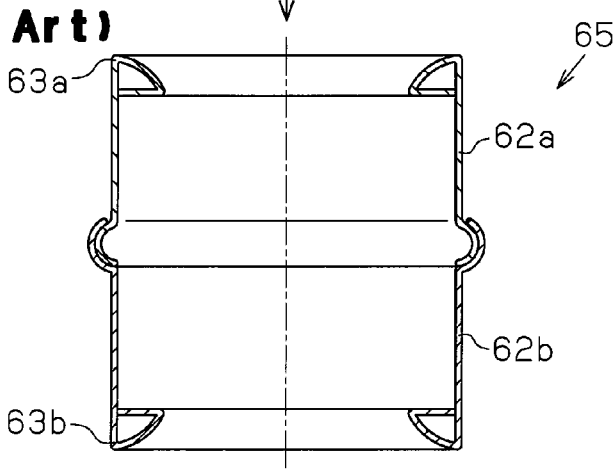
Fig.6(D) (Prior Art)
FIG. 6(D) is an explanatory view showing the manufacturing method for the conventional shell.
Figure 7:
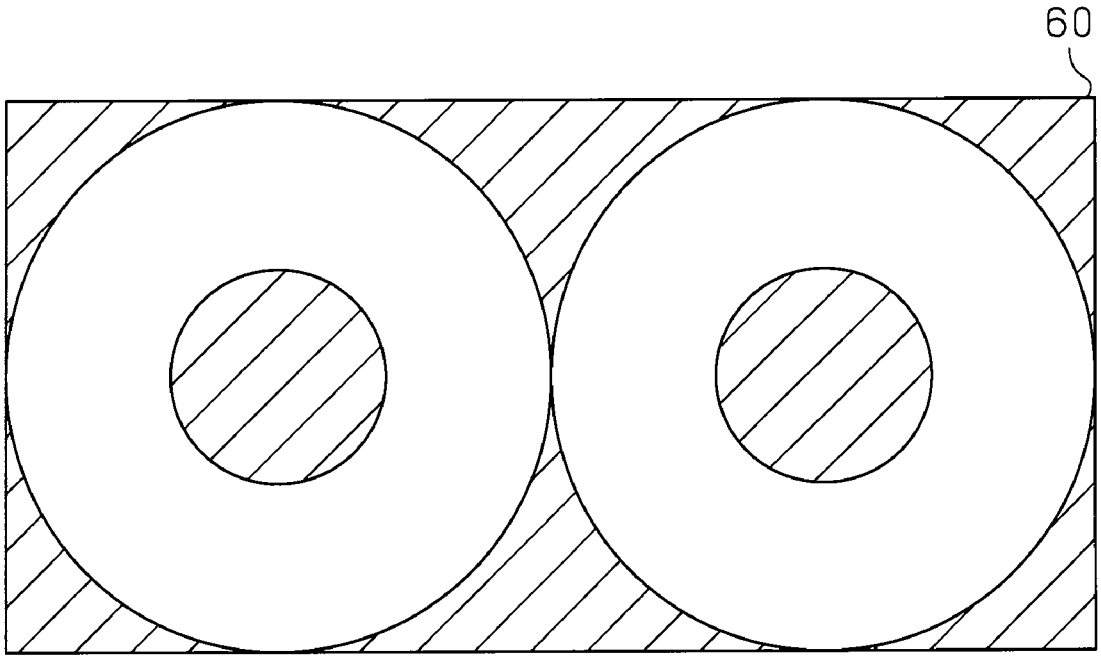
Fig.7 (Prior Art)
FIG. 7 is an explanatory view for explaining a waste part produced in a metal plate to be a raw material.

Also, the abovementioned embodiment may be modified as follows:

In the present embodiment, as shown in FIG. 4, the ring 27 may be joined, at the opening end of the cylinder 25, to an inner circumferential surface of the same cylinder 25. According to this construction, not only is the joining area between the ring 27 and the cylinder 25 sufficiently secured, but an overlapping part between the ring 27 and the cylinder 25 is also formed with a thicker wall than that of other parts, and thus the rigidity of the opening end of the shell 11 is further increased.

In the present embodiment, either one of the pair of rings 27 joined to both opening ends of the cylinder 25 may be omitted.

In the present embodiment, the reinforcing portion 21 may be solid.

In the present embodiment, the cross-sectional shape of the reinforcing portion 21 may be changed to an arbitrary shape such as a circular shape, an elliptical shape, a square shape, and a pentagonal shape.

In the present embodiment, the cylinder 25 and ring 27 may be formed from the same raw metal material.

In the present embodiment, the cylinder 25 may be formed from a raw metal material other than titanium or a titanium alloy.

In the present embodiment, the ring 27 may be joined to the opening end of the cylinder 25 by a joining method other than welding or brazing, for example, by use of a bolt or an adhesive.

The invention claimed is:

1. A reinforcing structure for reinforcing an opening end of a metal shell to which a drum head is mounted, the structure comprising:

the metal shell is comprised of a trunk portion with an opening end, and a reinforcing portion provided at the opening end of the trunk portion, the trunk portion is formed of a metallic cylinder having a diameter, the reinforcing portion is formed of a metallic ring having a same diameter as the diameter of the cylinder, and the ring is at and joined to at least one of the opening ends of the cylinder.

2. The reinforcing structure for a metal shell according to claim 1, wherein the shell has upper and lower ones of the opening ends and the structure further comprises a respective one of the metallic rings joined to the upper and the lower opening ends of the cylinder.

3. The reinforcing structure for a metal shell according to claim 1, wherein the reinforcing portion is a hollow ring.

4. The reinforcing structure for a metal shell according to claim 1, wherein the reinforcing portion has a triangular shape in cross-section.

5. The reinforcing structure for a metal shell according to claim 1, wherein the cylinder has an end face at the opening end and the ring is joined, at the opening end of the cylinder, to the end face of the cylinder.

6. The reinforcing structure for a metal shell according to claim 1, further comprising an inner circumferential surface of the cylinder at the opening end of the cylinder, to which the ring is joined.

7. The reinforcing structure for a metal shell according to claim 1, wherein the cylinder is formed of titanium or a titanium alloy.

8. A manufacturing method for a metal shell with a reinforcing structure for reinforcing an opening end of a metal shell to which a drum head is mounted, the method comprising:

shaping a rectangular metal plate to form a cylinder;

shaping a metal pipe to form a ring having the same diameter as that of the cylinder; and joining the ring to an opening end of the cylinder.

9. The manufacturing method for a metal shell according to claim 8, wherein the ring is formed by shaping the metal pipe into an annular shape after shaping the metal pipe into a triangular shape in cross-section, and joining both ends of the metal pipe to define the ring shape.

10. The manufacturing method for a metal shell according to claim 8, wherein the ring is joined to the opening end of the cylinder to an end face of the cylinder.

11. The reinforcing structure for a metal shell according to claim 3, wherein the reinforcing portion has a triangular shape in cross-section.

12. The reinforcing structure for a metal shell according to claim 3, wherein the trunk portion is of a thinner thickness in a radial direction than the reinforcing portion.

13. The reinforcing structure for a metal shell according to claim 1, wherein the trunk portion is of a thinner thickness in a radial direction than the reinforcing portion.

14. The reinforcing structure for a metal shell according to claim 7, wherein the ring is of a different metal than the metal shell.

15. In combination, the reinforcing structure of claim 1 and a drum head, the combination comprising:

a holder for the drum head to secure it tightly over the opening end of the shell and to tension the drum head; the drum head passing over and pressing against the reinforcing portion when the drum head is under tension such that the tension of the drum head is applied to the reinforcing portion, not directly to the shell at the end of the opening.

16. In combination, the reinforcing structure of claim 3 and a drum head, the combination comprising:

a holder for the drum head to secure it tightly over the opening end of the shell and to tension the drum head; the drum head passing over and pressing against the reinforcing portion when the drum head is under tension such that the tension of the drum head is applied to the reinforcing portion, not directly to the shell at the end of the opening.

* * * * *